US010706827B2

(12) United States Patent
Bahou

(10) Patent No.: US 10,706,827 B2
(45) Date of Patent: Jul. 7, 2020

(54) COLLAPSIBLE DRUM

(71) Applicant: Shafik N Bahou, New York, NY (US)

(72) Inventor: Shafik N Bahou, New York, NY (US)

( * ) Notice: Subject to any disclaimer, the term of this patent is extended or adjusted under 35 U.S.C. 154(b) by 205 days.

(21) Appl. No.: 15/893,585

(22) Filed: Feb. 10, 2018

(65) Prior Publication Data

US 2019/0251935 A1 Aug. 15, 2019

(51) Int. Cl.
*G10D 13/02* (2020.01)
*G10D 13/22* (2020.01)
*G10D 13/20* (2020.01)

(52) U.S. Cl.
CPC ..... *G10D 13/22* (2020.02); *G10D 13/02* (2013.01); *G10D 13/20* (2020.02)

(58) Field of Classification Search
CPC ..... G10D 13/028; G10D 13/027
USPC ..... 84/412
See application file for complete search history.

(56) References Cited

U.S. PATENT DOCUMENTS 1,214,171 A * 1/1917 King ..... G10D 13/028 84/412
1,223,237 A 4/1917 Barry
1,768,438 A 6/1930 Clark
2,546,452 A 3/1951 Kmieliauskas
4,300,437 A 11/1981 Hinger
7,786,364 B2 8/2010 Natali
8,267,271 B2 * 9/2012 Faris ..... B65D 11/02 220/703
8,525,010 B2 9/2013 Saravis
8,829,320 B2 9/2014 Tahour
10,192,532 B2 * 1/2019 Daure ..... G10D 13/02

* cited by examiner

*Primary Examiner* — Jianchun Qin
(74) *Attorney, Agent, or Firm* — Melger IP Law PLLC; Tod M Melgar

(57) ABSTRACT

An enhanced collapsible drum provides for a collapsible and expandable drum that in its collapsed state provides for improved portability and storage, while in its expanded state maintains the look, feel and playing quality of a drum having a traditional unibody shell or base design. The collapsible drum may be comprised of an elongated base or shell portion divided into two or more sections which may be nested in the collapsed position and can be extended and locked together by mating interlocking components to form an elongated drum base or shell in the expanded position. The collapsible drum may additionally include an internal lighting device and control responsive to sound. The collapsible drum may also include a case, handles and a strap for carrying or supporting the drum while playing or for securing the drum sections in the closed position.

14 Claims, 6 Drawing Sheets

COLLAPSIBLE DRUM

FIELD

The present innovations generally relate to drums, and more particularly to a drum having a collapsible base or shell structure for improved portability and storage.

BACKGROUND

Drums are one of mankind's oldest instruments dating back to at least 5500 BC and have been used for a wide variety of purposes from artistic expression and religious ceremonies to communications and setting cadence for marching armies.

Drums typically consist of a membrane or skin stretched over an open-ended base or shell where the taught skink stretch over the shell is struck with the hand or a stick to produce sound. Some drums have a skin stretched over the bottom of the base as well. Drums come in many shapes and sizes and are made of a variety of materials. For example, drum skins are typically made from animal or synthetic skins and drum shells are typically constructed from wood, metal, fiberglass or synthetic materials. Some drums are sized to be readily carried around the waist or neck so that they can be played while standing or marching. Others have long or elongated bases and may stand on their own so that the drum head is positioned at an appropriate height to be played with the drummer in a seated position. Drums also come in many shapes, including, cylindrical shape (steel drum), goblet or chalice shape (tarabuka, tarabaki, darbuka, debuka, doumbek, dumbec, dumbeg, dumbelek, tablah, toumperleki or zerbaghal drums), barrel shape (conga, tumbadora, or kpanlogo drums), and box shape (cajon drum).

The diameter, depth, thickness and shape of the base or shell define the resonance chamber or cavity of the drum which along with the skin thickness and tightness define the overall sound of the drum. Generally, the bigger the drum the louder the sound, so that drums with deep thick shells produce louder sound than drums with shallow thinner shells. As a result many drums can be bulky and large in size making them cumbersome to transport and store.

While most drums are not so large that musicians cannot transport them by car or other means, many are bulky, hard to carry and take up an inordinate amount of space. Although there have been attempts by others to create collapsible drums to address these problems, the known collapsible drums have numerous deficiencies and limitations including reduced sound quality, complex and difficult mechanisms for expansion and contraction of the base, and/or increased number of parts and manufacturing costs.

SUMMARY

The present disclosure solves the above needs and deficiencies with these known collapsible drums while maintaining superior sound quality. The present disclosure provides a collapsible drum having a base portion comprised of two or more interlocking base sections that are easily expanded and contracted, and locked and unlocked in place preferably through a twisting or rotation of the sections with respect to one another while providing a secure and rigid interlock between sections to maintain superior sound quality while disminishing vibration of the interlocking sections.

In one embodiment, the collapsible drum may be achieved by dividing the drum base or shell into three sections—a first base portion, a second base position and a third base portion. The first base portion is adapted to receive a drum head at the upper end and has a lower end adapted to connect to the upper end of the second base portion. The second base portion has an upper end adapted to connect to the lower end of the first base portion and a lower end adapted to be connected upper end of the third base portion. The third base portion has an upper end adapted to connect to the lower end of the second base portion, and a lower end preferably contains an opening to the resonance cavity formed in the interior of the three base portions, or alternatively may be adapted to receive a skin similar to the top base portion.

In one embodiment, the first, second and third base portions are preferably adapted to connect to one another by one or more mating flanges and locking channels at the junction of opposing base portion sections, wherein a flange on one portion is received in a locking channel of a receiving portion. In this arrangement the portions are preferable joined by sliding the flange into a vertical grove portion of a locking channel and then rotating the base portions with respect to one another to rotate the flange into a horizontal groove portion of the locking channel. In some embodiments a bump and detent arrangement may be provided on the meeting flange and groove to secure the base portions in position and prevent unintended rotation while playing.

In alternative embodiments, bumpers may be incorporated on the interior, and/or upper and/or lower ends of the drum base portions to stabilize or prevent marring of the base section exterior surface when the drum is in a collapsed position.

In yet other embodiments, a light producing device may be incorporated in the resonance cavity or interior of the drum base portion to provide lighting effects. In various embodiments the lighting may uniquely be controlled by a processor connected to a sound or vibration sensor for sensing drum playing and producing lighting effects in response to playing.

In yet other embodiments, the drum may also include a strap mounting for carrying or hold the drum in its expanded or collapsed state. In yet other embodiments, a strap may be used on the mountings carry the drum in its expanded state or to secure the drum in its collapse state. Alternatively, or in addition to the securing strap, the drum may include a carry case for securing the drum in its collapsed state.

While a detailed disclosure is further presented herein in the context of a chalice or goblet shaped doumbek drum having a collapsible base portion divided in three sections by example, it will be understood by those of ordinary skill in the art that the concepts may be applied to other drum types where there is a beneficial advantage to collapsing the drum for transport or storage while maintaining a high sound quality, as well as, dividing the drum base into fewer or greater numbers of sections. With the foregoing overview in mind, specific details will now be presented, bearing in mind that these details are for illustrative purposes only and are not intended to be exclusive.

BRIEF DESCRIPTION OF THE DRAWINGS

The accompanying drawings illustrate various non-limiting examples and innovative aspects of the collapsible drum in accordance with the present description.

DETAILED DESCRIPTION

Introduction

In simplified overview, a collapsible drum is described herein for providing a drum base that can be collapsed to a small size for easy storage and transportation while maintaining ease of use and sound quality. For example, certain drum types have large elongated bodies or shells, such as a congo or doumbek style drums which are relatively narrow in diameter and long. The size and length or height of these drums make transportation cumbersome and requires extra storage space. As a result, drummers either have to carry a cumbersomely sized drum or purchase multiple drums to leave at home, studio or auditoriums where they play. Without ease in portability, musicians are less likely to take the instrument with them and have impromptu sessions. The disclosure herein solves these problems by providing a uniquely portable and easy to use collapsible drum with enhanced sound quality as shown by example in the context of a doumbek. Moreover the collapsible nature of the drum allows it to be easily stored and transported in a case, which can provide protection for the drum and the ornate design details typically found on the exterior shell base of doumbek and other style drums.

Collapsible Drum

Figure 1:
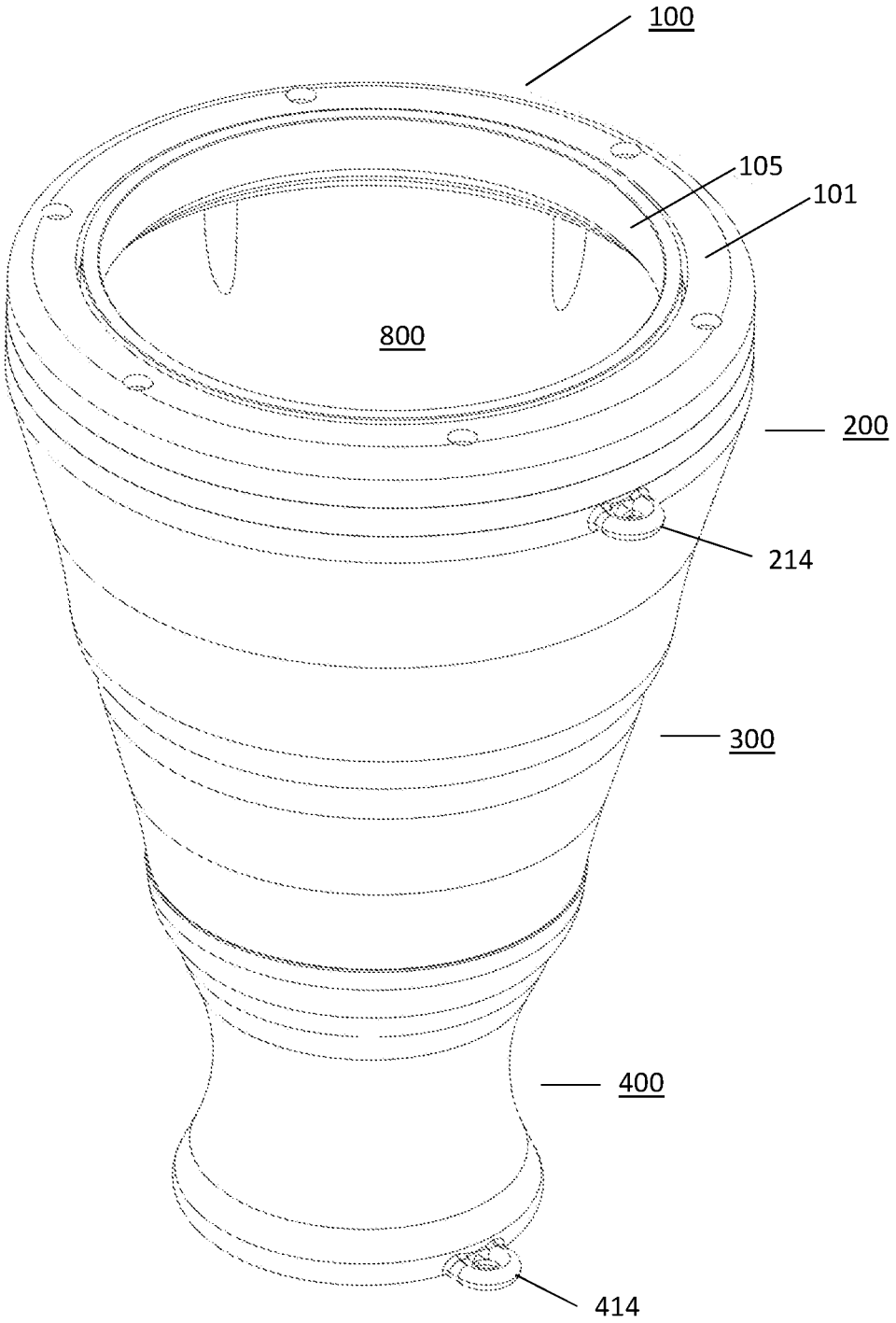
FIG. 1 shows an isometric view of one embodiment of the collapsible drum in an expanded position.

FIG. 1 illustrates in simplified form one example arrangement of a doumbek style drum described herein for use by a drummer. The drum shape is preferably in the form of a modified goblet or chalice shape wherein the drum base can preferably be divided into two or more nestable sections that can be received within each other when collapsed. A traditional doumbek has a drum head (100) and a base (200, 300, 400). In a preferred embodiment the base is divided into three sections—a large diameter top or first base portion (200) tapering from top to bottom, a narrower diameter middle or second base portion (300) tapering from top to bottom, and a lower or third base portion (400) that tappers and then expands in diameter from top to bottom.

Figure 2A:
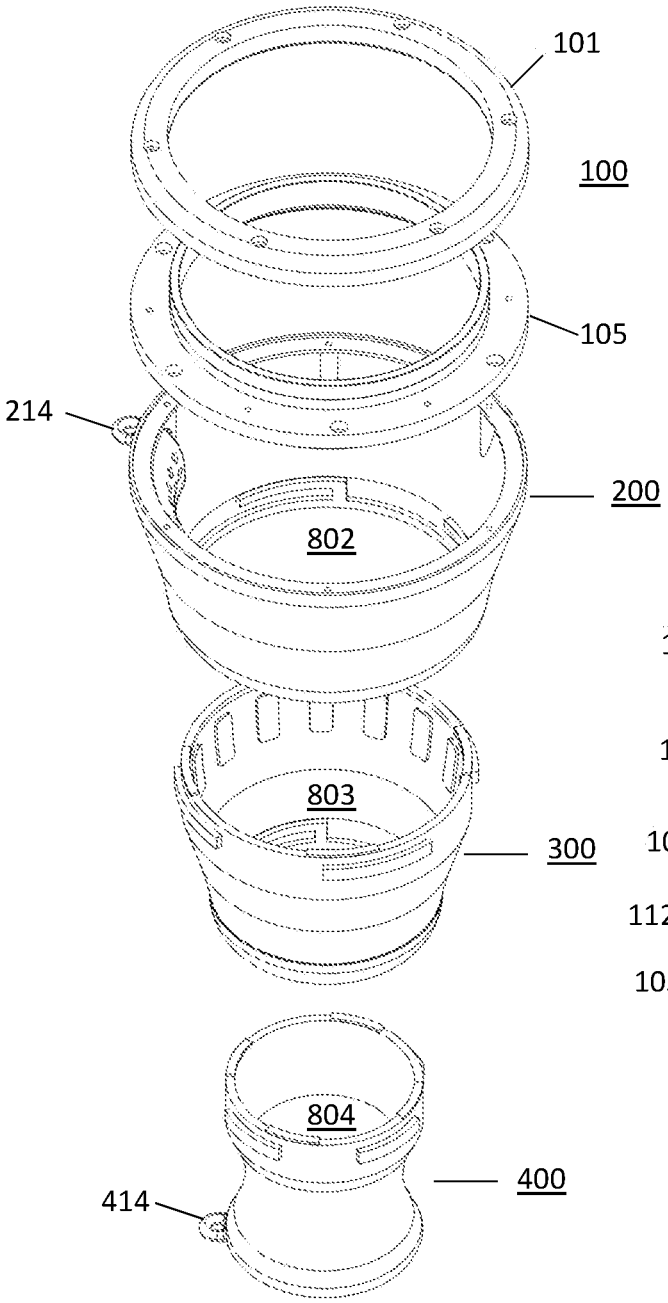
FIG. 2*a* shows an isometric exploded view of one embodiment of a collapsible drum.
Figure 2B:
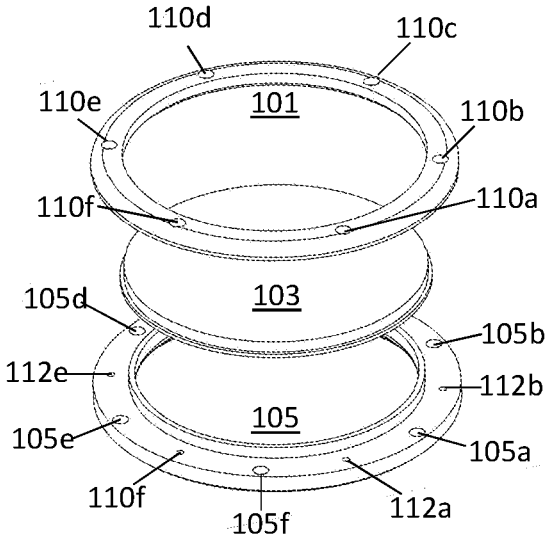
FIG. 2*b* shows an isometric exploded view of one embodiment of a drum head.

Referring to FIGS. 2*a* and 2*b*, exploded views of one embodiment are shown having a drum head and three base portions. As illustrated in FIG. 2*a*, this embodiment includes drum head section (100) and first, second and third base portions (200, 300 and 400). The drum base portions each are formed from a typically tubular thin shell having an interior and exterior surface and a central resonance cavity portions (802, 803, 804) that when formed together define the drums resonance cavity (800). FIG. 2*b* provides further detail of the drum head and preferably includes a mounting ring (105), a drum skin (103) and retaining ring (101). The mounting ring (105) preferably includes a plurality of screw holes (105*a-f*) for securing the mounting ring (105) to the first base portion (200) using screws in screw holes (105*a-f* (FIG. 2*b* not all shown)) threaded into threaded mounting holes (205*a-f* (FIG. 5 not all shown)) in the first base portion (200). The drum head skin (103) is then preferably removably mounted and secured to the head by securing the skin (103) with retaining ring (101). Retaining ring (101) may be secured by any securing means including screws secured through screw holes (110*a-f*) into corresponding threaded mounting holes (112*a-f* (FIG. 2*b* not all shown)), clamps or the like.

The base of the drum (200, 300, 400) may be made from any substantially rigid material. Typically drum bodies are made from materials such as wood, fiberglass or plastic, and many are decorated or embellished with ornate decorations and designs. The drum retainer ring (101) and drum mounting ring (105) are preferably made from metal such as brass or other decorative metal, but may be composed of any rigid material. The drum skin (103) is traditionally made from animal skin but may be composed of any suitable material including synthetic skins or any other known drum head material.

The collapsibility of the drum is facilitated by interlocking components of the drum base portions which permit the portions to be readily decoupled and nested at least partially inside one another to reduce the length of the drum for travel and storage. It is preferable that at least 50 percent of the longitudinal length of each base portion be able to be received in the portion it nests inside. In alternate embodiments, to achieve maximum size reduction, it is preferable that the base portions either fully nest within one another or achieve near complete nesting with greater than 80 percent of the uncollapsed longitudinal length being nested in the collapse state.

Figure 3:
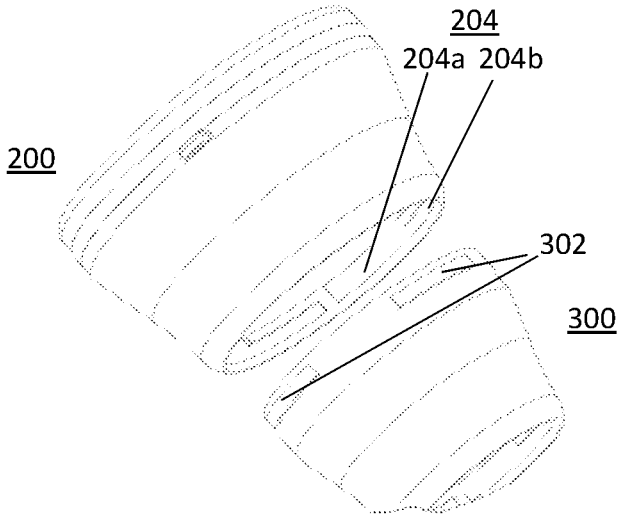
FIG. 3 shows an isometric exploded view of one embodiment of the interlock between drum base portions.
Figure 4:
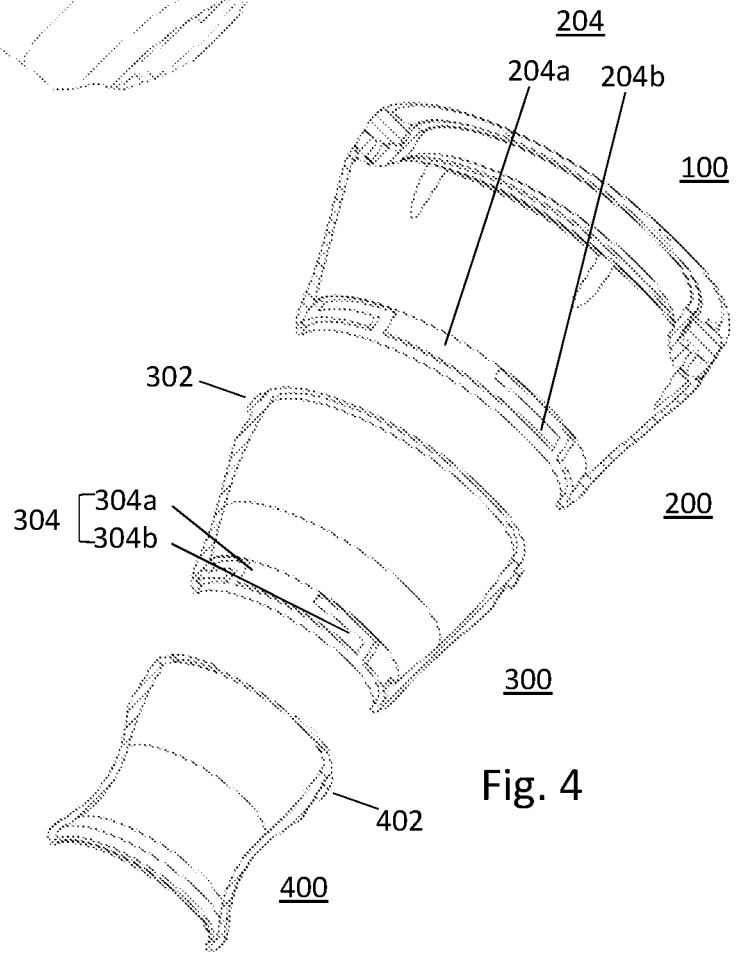
FIG. 4 shows an isometric exploded cross-sectional view of one embodiment of the interlock between drum base portions.

Referring to FIGS. 3 and 4, exploded views of one embodiment of the interlocking arrangement of the drum base portion are shown. FIG. 3 shows an exploded view of the interlocking interface between a first base portion (200) and second base portion (300). FIG. 4 shows a cross-sectional view of an interlocking arrangement between a first base portion (200), second base portion (300) and third base portion (400). Referring to FIGS. 3 and 4, the interlock preferably includes locking channels (e.g., 204, 304) and mating locking flanges (e.g, 302, 402) wherein the locking flange of one base portion is received by the locking channel of the adjacent base portion. For example, as shown in FIGS. 3 and 4, first base portion (200) includes a locking channel (204) having a locking channel vertical groove (204*a*) and locking channel circumferential grove (204*b*) which are sized to receive a corresponding locking flange (302) on an adjacent end of second base portion (300). In operation the locking flanges are moved into their corresponding locking channel vertical grooves and the drum base portions are turned with respect to one another to slide one or more locking flanges into corresponding locking channel circumferential grooves of the corresponding locking channels. In various embodiments of the disclosure, each base portion (200, 300, 400) connects to the adjacent base portion via two or more interlocking components; i.e., locking flanges and channels. For example, as shown in FIGS. 3 and 4, there are a plurality of flanges (402) on base portion (400) that are received in a plurality of corresponding locking channels (304) on base portions (300).

Figure 5:
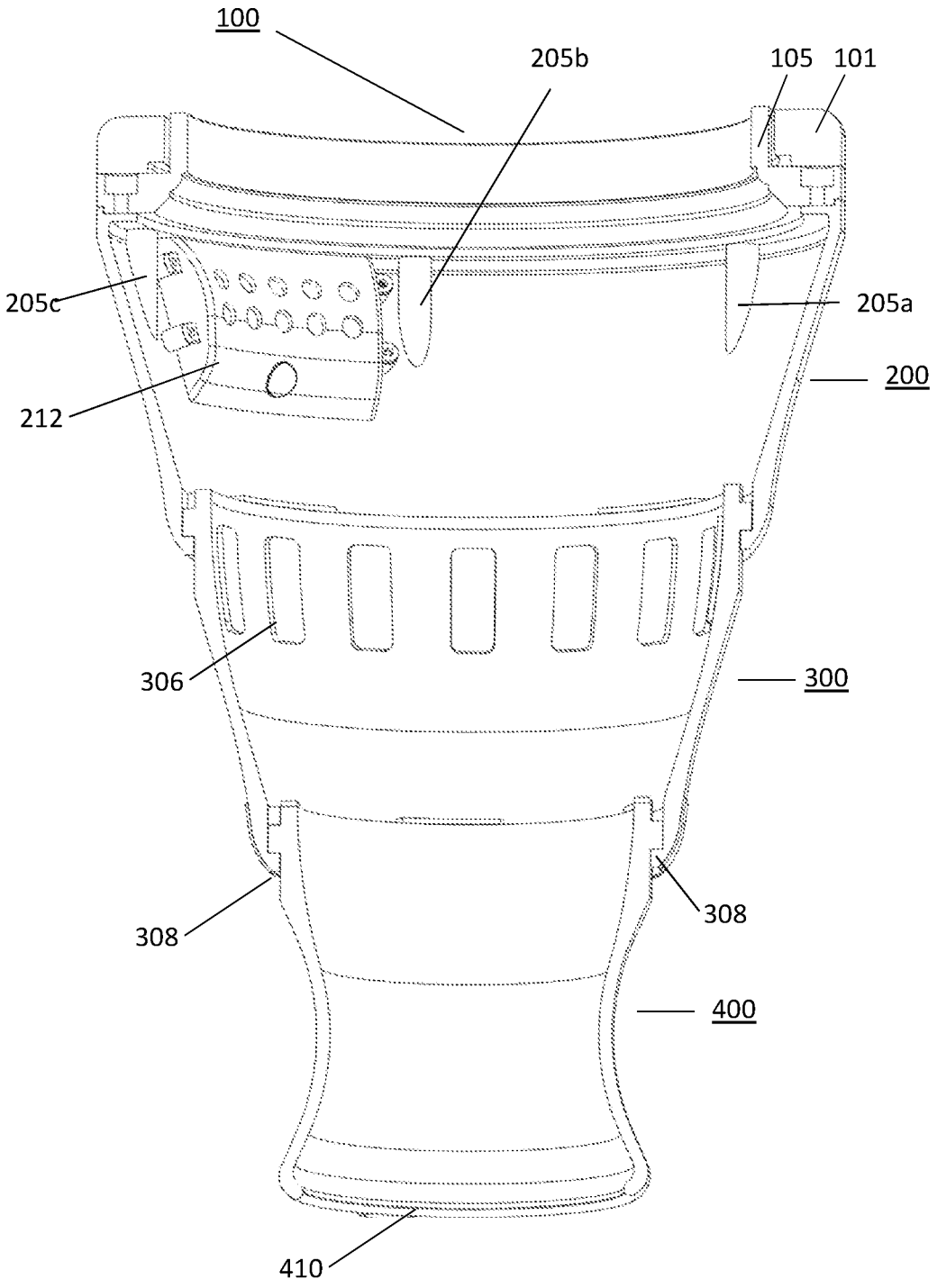
FIG. 5 shows a side cross-section view of one embodiment of the collapsible drum in an expanded position.
Figure 6:
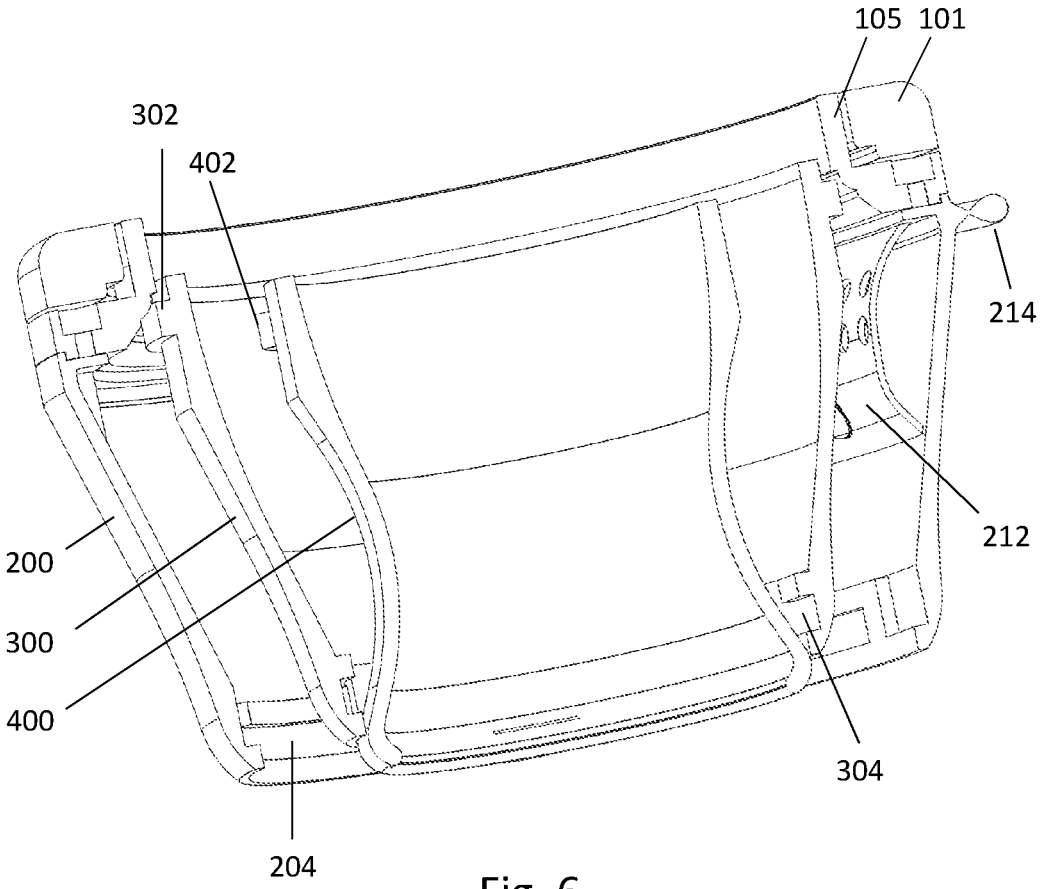
FIG. 6 shows an isometric cross-section view of one embodiment of the collapsible drum in a collapsed position.

FIGS. 3 and 4 depict an exploded view of the collapsible drum for ease of illustrating the interlocking engagement components. When the collapsible drum is assembled and in operation, however, the third base portion is nested inside the second base portion and those two portions are nested inside the first base portion as shown in FIG. 6. Referring to FIG. 6 the exemplary drum is shown in a collapsed state where the first, second and third base portions (200, 300, 400) are nested such that the third base portion (400) is substantially inside the second base portion (300) and those two base portions (300, 400) are in turn nested substantially within the first base portion (200). Preferably, when the drum is expanded the first, second and third base portions (200, 300, 400) are drawn or moved away from one another along a longitudinal axis extending through the centerline of the drum until the interlocking portions of adjacent sections meet. For example, as the base portions are moved apart, the locking flange (302) of the second base portion (300) will be received and drawn downward into the locking channel vertical grove (204*a*) of the first base portion (200), and the locking flange (402) of the third base portion (400) will be received and drawn downward into the locking channel vertical grove (304*a*) of the second base portion (300). Once the locking flanges (302, 402) are seated at the bottom of the locking channel vertical grooves (204*a*, 304*a*), respectively, the first, second and third base portions are rotated with respect to one another so that the locking flanges (302, 402) rotate into the corresponding locking channel circumferential grooves (204*b*, 304*b*). Once in place the locking channel circumferential grooves (204*b*, 304*b*) are seating on the flanges (302, 402) to support base portions and retain the drum base in an expanded state. Referring to FIG. 5, a cross-sectional view of the drum base is shown in the expanded state with the flanges rotated into the locking channel circumferential grooves.

As discussed above, in various embodiments, the drum base portions preferably each have a plurality of locking flanges and mating locking channels. For example, referring to FIG. 3, second base portion (300) has a plurality of locking flanges (302) which mate with a plurality of corresponding locking channels (204). It is preferable that each portion include three interlocking flanges and channels to provide stability to the interlock. In addition, while the drawings depict an arrangement of locking flanges on one portion and mating locking channels on another portion, nothing in the disclosure is intended to limit the arrangement of locking channels and locking flanges in that they may be reversed. For example, the lower end of first base portion (200) may have flanges which mate with a locking channel on the upper portion of second base portion (300). Additionally, the positioning of the flanges and channels on mating inner and outer surfaces of the base portions may be reverse, so long as they engage one another when the two sections are brought together.

Additionally, the locking flanges and locking channels also may include a rotational restraining means such as a mating protrusion and detent so that when the drum portions are rotated into place a protrusion on the flange may engage with a detent in the locking channel or vice versa to limit inadvertent rotation and collapse of the drum base portions.

In some drum designs a base portion may be sized such that the upper and lower end of a portion are both larger in diameter than a section into which it must be received. In such cases the pieces must be molded in place or an alternate means of assembly must be provided. For example, referring to FIG. 6, the third base portion (400) is hour glass shaped and has an upper and lower diameter that is larger than the lower diameter of the second base portion (300). As a result, the third base portion (400) cannot pass through either the upper or lower end of second base portion (300). In this instance, the second and third base portions may be molded in position, the base of the third portion (400) may be designed with a reduced diameter and sized so that it can pass through the lower end of the second base portion (300), or referring to FIG. 5, a lower portion of the locking channel (304c) may be removeable or have a cutout to allow the locking flange (402) of the third base portion (400) to pass through the bottom of the third base portion (300) during assembly of the drum.

In alternate embodiments, the drum also includes upper and lower carry strap hooks (214, 414) to which a drummer can mount a carry strap. These hooks can also serve as restraining hooks so that the drum may be secured with a strap when in the collapsed position to prevent accidental expansion. For example, using an adjustable strap or short cord the drummer can secure the drum in a closed position by looping the cord through strap hooks (214, 414) or by shortening the strap to the distance or length between the strap hooks in the collapsed position.

Figure 7:
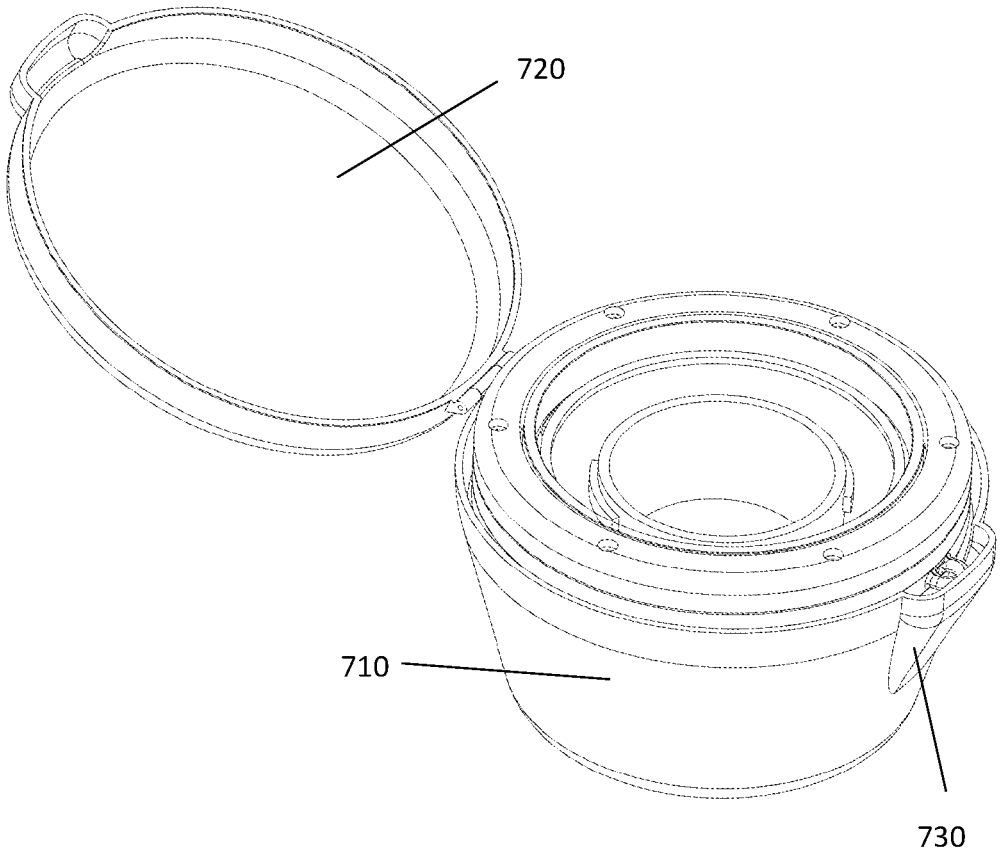
FIG. 7 shows an isometric view of one embodiment of the collapsed drum in a storage case.

Referring to FIG. 7, the drum may alternatively include a carry case for facilitating the transport, storage and protection of the drum in a collapsed state. The case includes a base portion (710) and a lid (720) having a locking latch (730).

Referring to FIG. 5, alternate embodiments of the drum may also include a lighting effects system (212). The lighting effects systems may include sound or vibration sensors, a processor, a power source, a lighting controller and lights. Preferably the lighting effects system used multicolored, low power LED lights so that the system can run for long periods of time from battery power. The lighting effects system receives and processes sound or vibration and in turn permits the control of lighting effects in response to the sound or vibration. For example, in some embodiments the intensity or color of light may be responsive to the intensity or tone of the sound being produced by the drummer. The lighting effects system is preferably disposed and secured to the inside wall of the first base portion (200) so the lighting effects can be seen through the skin of the drum, from the base portion of the drum and/or through the walls of the drum where the base portions are wholly or partly made from light transmissive material. In the case where the base portion is made from a translucent material, the lighting effects system may be formed in a ring and be included with or under the mounting ring or elsewhere along the interior wall of the drum base portion so that either no shadow will be cast on the shell or base wall or that the shadow cast will be symmetrical around the wall of the drum. For example, the lighting effects system may be mounting in a plurality of bumpers (306 discussed below) or integrated into mounting ring (105) with light directed to the interior of the drums resonance cavity (800).

Referring further to FIG. 5, in various embodiments the drum further may include interior bumpers (306) on the inner wall of the second base portion. The interior bumpers serve to prevent or minimize damage from the third base portion (400) hitting the interior side walls of the second base portion (300) when the drum is in its collapsed state. Similarly, referring to FIG. 5, the lower end of the second base portion (300) may further include bumpers (308) to prevent marring the exterior of the third base portion when the drum is in a collapsed state. These features are particularly important in drum designs with ornate or delicate exterior surfaces where repeated rubbing of the base portion sections in the collapsed state could damage the asthetic features of the drums. The bumpers are preferably made of soft rubber, silicone or other suitable cushioning material and can be applied to other base portions that may contact with each other in the collapsed state to prevent damage to the drum surface.

It should be understood that this description (including the figures) is only representative of some illustrative embodiments. For the convenience of the reader, the above description has focused on representative samples of all possible embodiments, and samples that teach the principles of the disclosure. The description has not attempted to exhaustively enumerate all possible variations. That alternate embodiments may not have been presented for a specific portion of the disclosure, or that further undescribed alternate embodiments may be available for a portion, is not to be considered a disclaimer of those alternate embodiments. One of ordinary skill will appreciate that many of those undescribed embodiments incorporate the same principles of the disclosure as claimed and others are equivalent.

What is claimed is:

1. A collapsible drum comprising:

a drum head;

an elongated drum base forming a resonance cavity extending from an upper end to a lower end wherein a cross-section of the resonance cavity has a circular shape, and wherein a circular cross-section at the upper end is greater in diameter than a circular cross section at the lower end, and at least one circular cross-section between the upper end and lower end is smaller in diameter than the cross-section at the upper end and the cross-section at the lower end, and wherein cross-sections of the resonance cavity have a smooth uninterrupted circular shape over a majority of the resonance cavity from the upper end to the lower end;

wherein the drum base comprises at least a first base portion and a second base portion arranged along a longitudinal axis;

wherein the first base portion is in the form of a ring having an inner wall and an outer wall extending along the longitudinal axis from an upper end to a lower end, and wherein the inner wall defines a first resonance cavity portion, wherein the inner and outer walls have a circular shaped cross-section having a gradually varying cross-sectional diameter from an upper end to a lower end, wherein the circular shaped cross-section is uninterrupted over a majority of the inner wall from the upper end to the lower end, and wherein the upper end of the first base portion is adapted to receive the drum head and the lower end has a first engaging portion, the first engaging portion being disposed proximate the lower end and distant from the upper end;

wherein the second base portion is in the form of a ring having an inner wall and an outer wall extending along the longitudinal axis from an upper end to a lower end, and wherein the inner wall defines a second resonance cavity portion, wherein the inner and outer walls have a circular shaped cross-section having a gradually varying cross-sectional diameter from an upper end to a lower end, wherein the circular shaped cross-section is uninterrupted over a majority of the inner wall from the upper end to the lower end, and wherein the upper end of the second base portion has a second engaging portion, the second engaging portion being disposed proximate the upper end and distant from the lower end;

the first engaging portion adapted to removably engage and disengage the second engaging portion wherein the first and second engaging portions are adapted to engage and disengage through rotation of the first engaging portion with respect to the second engaging portion; and the first base portion being sized to at least partially receive the second base portion within the first resonance cavity portion; and a lighting effects unit disposed in the resonance cavity and having a plurality of lights, at least one of a microphone, motion or pressure sensor, a power supply and a processor adapted to energize a light in response to drum play; and a plurality of bumpers disposed circumferentially on the inner wall of the first base portion.

2. The collapsible drum of claim 1, wherein, the first engaging portion comprises a circumferential channel along at least a portion of an interior wall of the first base portion and the second engaging portion comprises a flange along a least a portion of an exterior wall of the second base portion, and the circumferential channel of the first base portion is adapted to receive the flange on the second base portion only when the drum is in an expanded state.

3. The collapsible drum of claim 2, wherein the circumferential channel comprises a vertical groove in communication with a circumferential groove, and wherein the flange is sized to be received in the vertical groove when the first base portion and second base portion are moved in a longitudinal direction away from one another, and sized to be received in the circumferential groove when the first base portion and second base portion are rotated with respect to one another around a longitudinal axis.

4. The collapsible drum of claim 1, wherein the first engaging portion comprises a plurality of discrete circumferential channels along an interior wall of the first base portion and the second engaging portion comprises a plurality of flanges along a least a portion of an exterior wall of the second base portion, and wherein the circumferential channels of the first base portion are adapted to receive the flanges on the second base portion only when the drum is in an expanded state.

5. The collapsible drum of claim 4, wherein each of the plurality of discrete circumferential channels comprises a vertical groove in communication with a circumferential groove, and wherein each of the flanges is sized to be received in a corresponding vertical groove when the first base portion and second base portion are moved in a longitudinal direction away from one another, and sized to be received in the circumferential groove when the first base portion and second base portion are rotated with respect to one another around a longitudinal axis.

6. The collapsible drum of claim 5, wherein there are three or more discrete circumferential channels equally spaced around the circumference of the first base portion, and wherein there are three or more flanges equally spaced around the circumference of the second base portion.

7. The collapsible drum of claim 1, wherein the first engaging portion includes a protrusion or detent adapted to engage a corresponding detent or protrusion of second engaging portion when the first and second engaging portions are engaged to resist relative rotation of the first base portion and second base portion along a longitudinal axis of the drum, whereby accidental collapse of the drum base is prevented.

8. The collapsible drum of claim 1, wherein the drum base further comprises a third base portion arranged along a longitudinal axis;

wherein the third base portion is in the form of a ring having an inner wall and an outer wall extending along the longitudinal axis from an upper end to a lower end, and wherein the inner wall defines a third resonance cavity portion, wherein the inner and outer walls have a circular shaped cross-section having a gradually varying cross-sectional diameter from an upper end to a lower end, wherein the circular shaped cross-section is uninterrupted over a majority of the inner wall from the upper end to the lower end, and wherein the upper end of the third base portion has a fourth engaging portion, the second engaging portion being disposed proximate the upper end and distant from the lower end;

wherein the second base portion further includes a third engaging portion at the lower end;

the third engaging portion is adapted to removably engage and disengage with the fourth engaging portion and wherein the third and fourth engaging portions are adapted to engage and disengage through rotation of the third engaging portion with respect to the fourth engaging portion; and the second base portion being sized to at least partially receive the third base portion within the first resonance cavity portion.

9. The collapsible drum of claim 8, wherein the first base portion further comprises an upper carry strap hook and the third base portion further includes a lower carry strap hook.

10. The collapsible drum of claim 9, wherein the collapsible drum further comprises an adjustable carry strap connected to the upper carry strap hook and lower carry strap hook and adapted to be adjustable between a first length to carry the drum in an expanded state and a second length to secure the drum in a collapsed position when in a collapsed state.

11. The collapsible drum of claim 8, further comprising a carry case having a base and a lid, wherein the base has a cavity for receiving the drum in its collapsed state.

12. The collapsible drum of claim 1 wherein the lighting effects system is integrated into the plurality of bumpers with light directed into the resonance cavity.

13. The collapsible drum of claim 1 wherein the lighting effects system is integrated into a mounting ring for the drum head with light directed into the resonance cavity.

14. A collapsible drum comprising:

a drum head; and an elongated drum base forming a resonance cavity extending from an upper end to a lower end wherein a cross-section of the resonance cavity has a circular shape, and wherein a circular cross-section at the upper end is greater in diameter than a circular cross section at the lower end, and at least one circular cross-section between the upper end and lower end is smaller in diameter than the cross-section at the upper end and the cross-section at the lower end, and wherein cross-sections of the resonance cavity have a smooth uninterrupted circular shape over a majority of the resonance cavity from the upper end to the lower end;

wherein the drum base comprises at least a first base portion, a second base portion, and a third base portion arranged along a longitudinal axis;

wherein the first base portion extends along the longitudinal axis from an upper end to a lower end and defines a first resonance cavity portion, the upper end being adapted to receive the drum head and the lower end having a first engaging portion;

the second base portion extends along the longitudinal axis from an upper end to a lower end and defines a second resonance cavity portion, the upper end having a second engaging portion and the lower end having a third engaging portion;

the third base portion extends along the longitudinal axis from an upper end to a lower end and defines a third resonance cavity portion, the upper end having a fourth engaging portion and the lower end having an opening;

the first engaging portion adapted to removably engage and disengage the second engaging portion and the third engaging portion adapted to removably engage and disengage the fourth engaging portion;

wherein the first and second engaging portions are adapted to engage and disengage through rotation of the first engaging portion with respect to the second engaging portion;

wherein the third and fourth engaging portions are adapted to engage and disengage through rotation of the third engaging portion with respect to the fourth engaging portion;

the first base portion being sized to at least partially receive the second base portion within the first resonance cavity portion and the second base portion being sized to at least partially receive the third base portion within the second resonance cavity portion;

the first engaging portions comprise a circumferential channel along at least a portion of an interior wall of the first base portion and the second engaging portion comprises a flange along a least a portion of an exterior wall of the second base portion;

the third engaging portions comprise a circumferential channel along at least a portion of an interior wall of the second base portion and the second engaging portion comprises a flange along a least a portion of an exterior wall of the third base portion;

the circumferential channel of the first base portion is adapted to receive the flange on the second base portion when the drum is in an expanded state; and the circumferential channel of the second base portion is adapted to receive the flange on the third base portion when the drum is in an expanded state.

* * * * *